US008162312B2

(12) United States Patent
Tu et al.

(10) Patent No.: US 8,162,312 B2
(45) Date of Patent: Apr. 24, 2012

(54) SHEET PICK-UP DEVICE OF AUTOMATIC DOCUMENT FEEDER

(75) Inventors: Tung-Wen Tu, Taipei (TW); Jian Zeng, Guangzhou (CN); Jian-Gju Yu, Guangzhou (CN)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/885,764

(22) Filed: Sep. 20, 2010

(65) Prior Publication Data

US 2011/0316219 A1 Dec. 29, 2011

(30) Foreign Application Priority Data

Jun. 25, 2010 (TW) ..... 99120853 A

(51) Int. Cl.
*B65H 3/52* (2006.01)
*B65H 3/34* (2006.01)

(52) U.S. Cl. ..... 271/121; 271/167

(58) Field of Classification Search ..... 271/121, 271/167, 117
See application file for complete search history.

(56) References Cited

U.S. PATENT DOCUMENTS

| | | | | |
|---|---|---|---|---|
| 6,478,295 | B2 * | 11/2002 | Hwang et al. | 271/115 |
| 7,156,388 | B2 * | 1/2007 | Kang et al. | 271/110 |
| 7,331,575 | B2 * | 2/2008 | Kang | 271/121 |
| 7,665,725 | B2 * | 2/2010 | Bridges et al. | 271/124 |
| 7,837,188 | B2 * | 11/2010 | Lee et al. | 271/117 |
| 2002/0175462 | A1 * | 11/2002 | Sonoda et al. | 271/121 |
| 2005/0051945 | A1 * | 3/2005 | Kang | 271/121 |
| 2005/0082742 | A1 * | 4/2005 | Kang et al. | 271/121 |

* cited by examiner

*Primary Examiner* — Kaitlin Joerger
*Assistant Examiner* — Patrick Cicchino
(74) *Attorney, Agent, or Firm* — Kirton McConkie; Evan R. Witt

(57) ABSTRACT

A sheet pick-up device of an automatic document feeder is provided. The sheet pick-up device includes a two-way clutch transmission mechanism, a sheet pick-up arm, a stopper and a linking assembly. When the two-way clutch transmission mechanism is operated to have the sheet pick-up arm move to a standby position, the stopper is moved with the linking assembly to be in a stopping position. Whereas, when the two-way clutch transmission mechanism is operated to have the sheet pick-up arm move to a sheet pick-up position, the stopper is in a non-stopping position. The sheet pick-up device has enhanced operating stability.

6 Claims, 8 Drawing Sheets

SHEET PICK-UP DEVICE OF AUTOMATIC DOCUMENT FEEDER

FIELD OF THE INVENTION

The present invention relates to a sheet pick-up device, and more particularly to a sheet pick-up device of an automatic document feeder.

BACKGROUND OF THE INVENTION

Generally, an automatic document feeder has a function of automatically and successively feeding many paper sheets. The automatic document feeder is applied to a diversity of office machines such as multifunction peripherals, printers, faxing machines or scanners.

FIG. 1A is a schematic perspective view illustrating a conventional automatic document feeder. The automatic document feeder 1 as shown in FIG. 1A is applied to a printer. The automatic document feeder 1 comprises a sheet stopping mechanism 11, a sheet pick-up roller 12, a clutch gear 13, a belt 14, a motor 15, a big gear 16, an idle gear 17, a compound gear 18. The sheet pick-up roller 12 is used for transporting a paper sheet M into a sheet-feeding channel. The clutch gear 13 is used for driving rotation of the sheet pick-up roller 12. The belt 14 is driven to rotate by the motor 15. Upon rotation of the belt 14, the big gear 16 is rotated to simultaneously drive rotation of the clutch gear 13 and the idle gear 17. The compound gear 18 is rotated with the idle gear 17.

FIG. 1B is a schematic exploded view illustrating the sheet stopping mechanism of the automatic document feeder as shown in FIG. 1A. FIG. 1C is a schematic side view illustrating the automatic document feeder in a sheet-feeding status. The sheet stopping mechanism 11 comprises a swinging arm 110, a hollow ring 111, a coupling element 112 and a linking rod 113. In addition, plural elastic elements 111*a* are formed on the outer periphery of the hollow ring 111. The coupling element 112 is coupled with the hollow ring 111. The linking rod 113 is connected to the swinging arm 110 and a stopper 114. The swinging arm 110, the hollow ring 111 and the coupling element 112 are sheathed around an outer surface 181 of the compound gear 18. In a sheet pick-up status, the sheet pick-up roller 12 is rotated to transport the paper sheet M in a direction F (see FIG. 1C). Meanwhile, as the compound gear 18 is rotated, the elastic element 111*a* and a corresponding coupling element 112 are rubbed against each other to generate a friction force. Due to the friction force, the swinging arm 110 is swung, and thus the stopper 114 is switched to the non-stopping position without stopping the paper sheet M. In this situation, the paper sheet M is allowed to be fed into the sheet-feeding channel.

The conventional automatic document feeder 1, however, still has some drawbacks. For example, since the swinging arm 110 of the automatic document feeder 1 is swung in response to the friction force, which is generated from the nib between the elastic element 111*a* and the corresponding coupling element 112. In such way, the elastic element 111*a* may be suffered from thermal deformation. Due to the rubbing problem for a long time, the elastic element 111*a* is eventually abraded, and thus the long-term operating stability is deteriorated. In this situation, the use life of the automatic document feeder is shortened.

SUMMARY OF THE INVENTION

The present invention provides a sheet pick-up device of an automatic document feeder in order to enhance the operating stability.

In accordance with an aspect of the present invention, there is provided a sheet pick-up device of an automatic document feeder. The sheet pick-up device has functions of stopping a paper sheet from entering a sheet-feeding channel and feeding the paper sheet into the sheet-feeding channel. The sheet pick-up device includes a two-way clutch transmission mechanism, a sheet pick-up arm, a stopper and a linking assembly. The two-way clutch transmission mechanism includes a power input shaft and a clutch gear set coaxial with the power input shaft. The power input shaft is driven to rotate in either a clockwise direction or an anti-clockwise direction by a motor. The sheet pick-up arm is fixedly connected to the power input shaft and configured for transporting the paper sheet into the sheet-feeding channel. The stopper perpendicular to a stopper linking rod is used for stopping the paper sheet from entering the sheet-feeding channel. The linking assembly is connected to the power input shaft and the stopper. When the power input shaft is rotated in the clockwise direction, the sheet pick-up arm is in a standby position, and the stopper is moved with the linking assembly to be in a stopping position, so that the paper sheet is stopped from entering the sheet-feeding channel. Whereas, when the power input shaft is rotated in the anti-clockwise direction, the sheet pick-up arm is in a sheet pick-up position, and the stopper is moved with the linking assembly to be in a non-stopping position, so that the paper sheet is allowed to be fed into the sheet-feeding channel.

In an embodiment, the clutch gear set includes a position-changing plate, a driving gear, a first switching gear, a second switching gear and a notched gear. The position-changing plate is sheathed around the power input shaft and fixed on the power input shaft. The driving gear is disposed on the position-changing plate and sheathed around the power input shaft. The first switching gear is disposed on the position-changing plate. The second switching gear is disposed on the position-changing plate and engaged with the driving gear. The notched gear is disposed on a rotary shaft, and having a notch in a periphery thereof. When the power input shaft is rotated in the clockwise direction, the position-changing plate is rotated, so that the first switching gear is engaged with notched gear, the notched gear is rotated with the first switching gear, and the stopper is moved with the linking assembly to be in the stopping position. Until the notch of the notched gear is rotated to be aligned with the first switching gear, the first switching gear runs idle. When the power input shaft is rotated in the anti-clockwise direction, the position-changing plate is rotated, so that the second switching gear is engaged with notched gear, the notched gear is rotated with the second switching gear, and the stopper is moved with the linking assembly to be in the non-stopping position. Until the notch of the notched gear is rotated to be aligned with the second switching gear, the second switching gear runs idle.

In an embodiment, the clutch gear set further includes a transmission gear, which is disposed on the position-changing plate, and engaged with the driving gear and the first switching gear.

In an embodiment, the stopper is perpendicularly disposed on a stopper linking rod. The linking assembly includes a cam, a swinging arm and a repositioning structure. The cam is disposed on the rotary shaft. The swinging arm is disposed on the power input shaft, and swung in response to a rotary motion of the cam. The repositioning structure comprises a rotating rod, a poking part, a torsion spring, a first linking element and a second linking element. The poking part is perpendicular to the rotating rod and contacted with the swinging arm. The torsion spring is sheathed around the rotating rod, and contacted with the poking part for exerting a torsion force on the poking part. The first linking element is connected to an end of the rotating rod. The second linking element is perpendicular to the stopper linking rod and contacted with the first linking element.

In an embodiment, the rotary shaft is parallel with the power input shaft.

In an embodiment, the notched gear, the rotary shaft and the cam are integrally formed.

In an embodiment, the first linking element includes a hollow part and a position-limiting structure, and the second linking element is penetrated through the hollow part, and contacted with the position-limiting structure of the first linking element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a sheet pick-up device of an automatic document feeder of an office machine such as a printer. The automatic document feeder is suitable for picking up paper sheets from the bottom side.

Figure 1A:
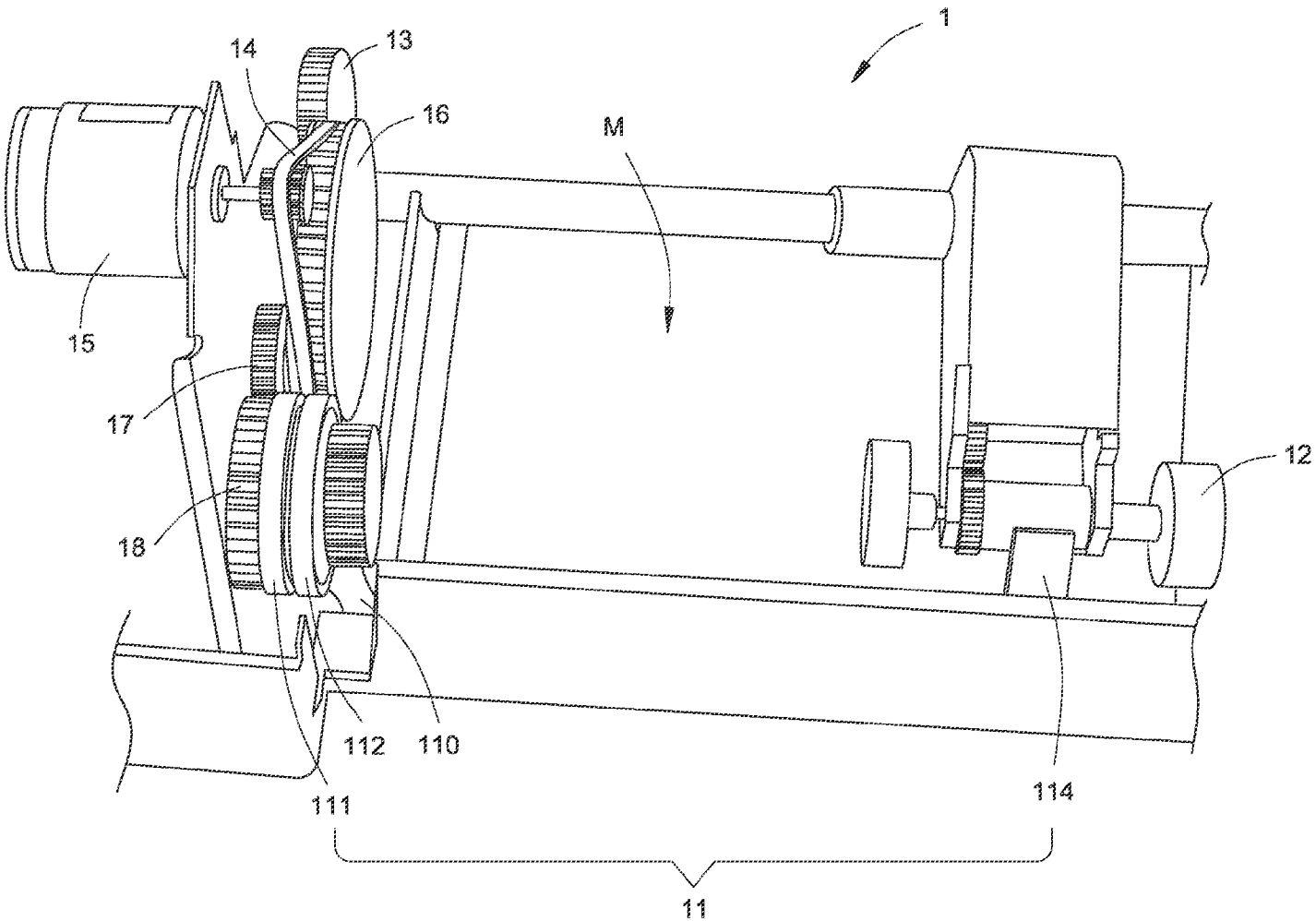
FIG. 1A (PRIOR ART)
FIG. 1A is a schematic perspective view illustrating a conventional automatic document feeder.
Figure 1B:
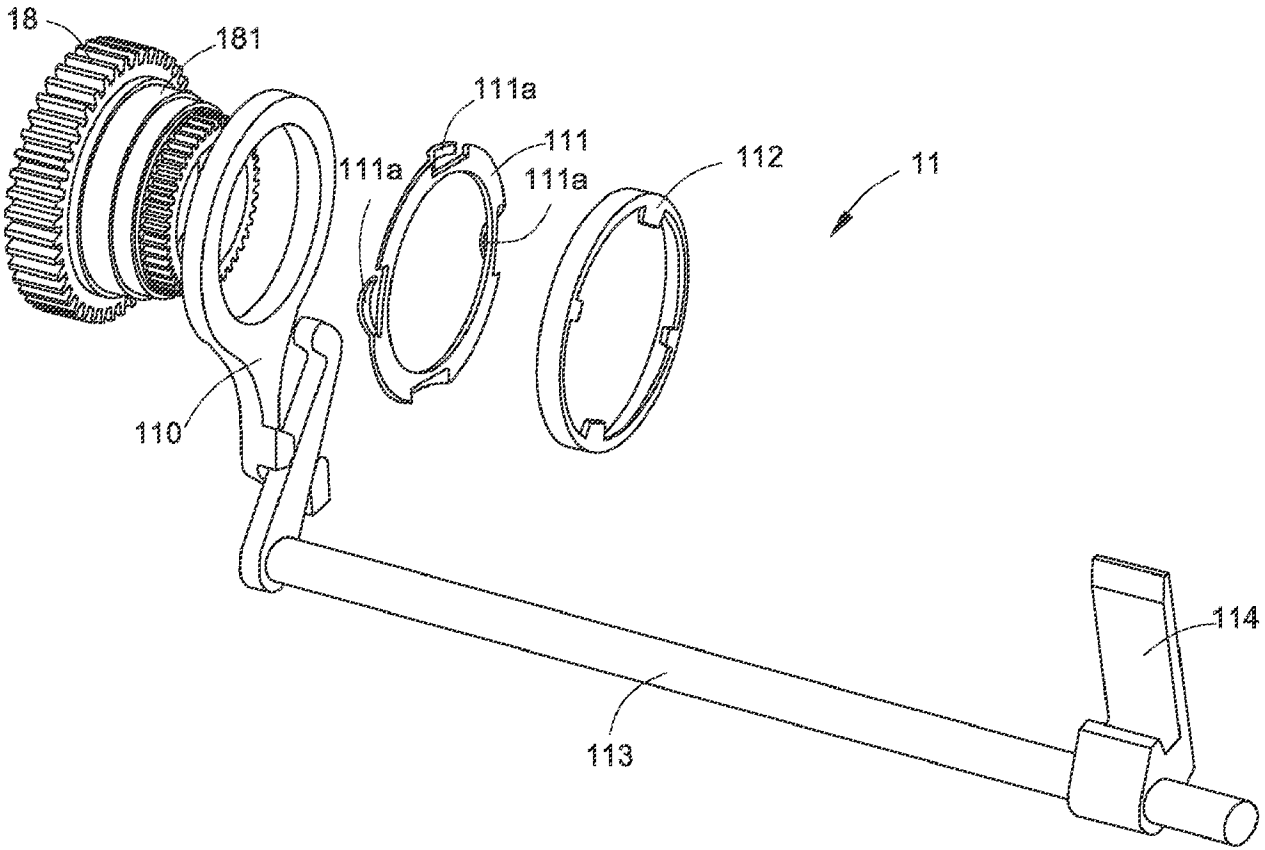
FIG. 1B (PRIOR ART)
FIG. 1B is a schematic exploded view illustrating the sheet stopping mechanism of the automatic document feeder as shown in FIG. 1A.
Figure 1C:
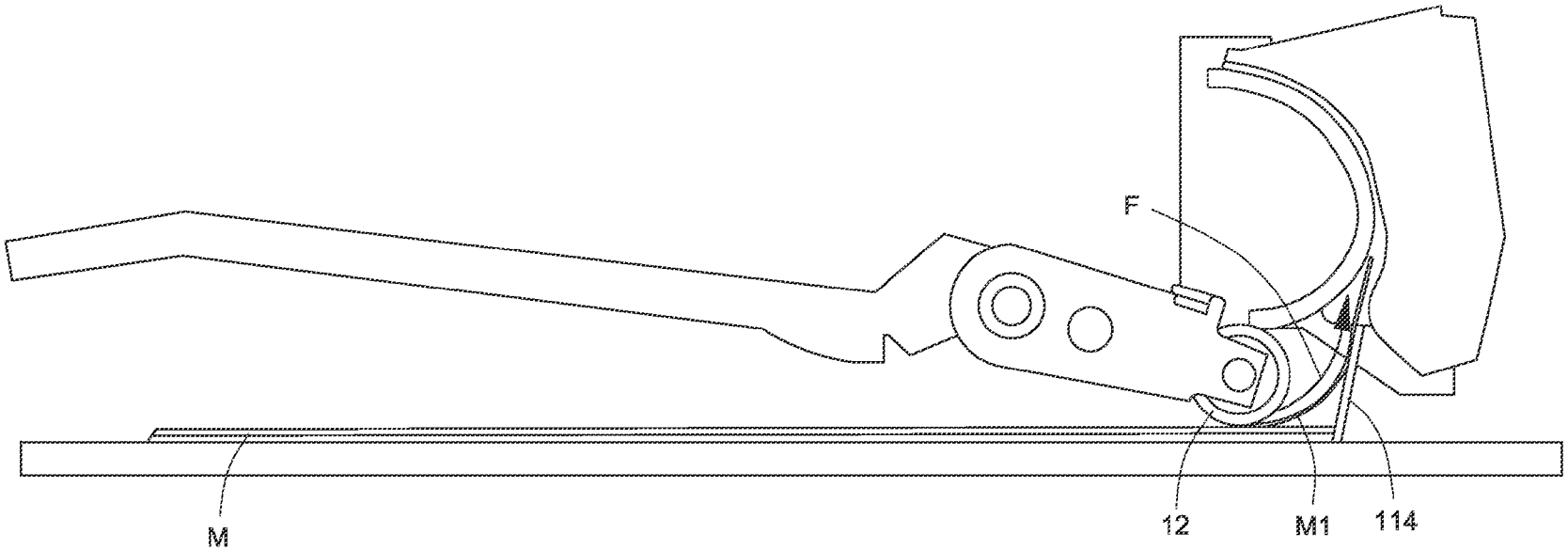
FIG. 1C (PRIOR ART)
FIG. 1C is a schematic side view illustrating the automatic document feeder in a sheet-feeding status.
Figure 2:
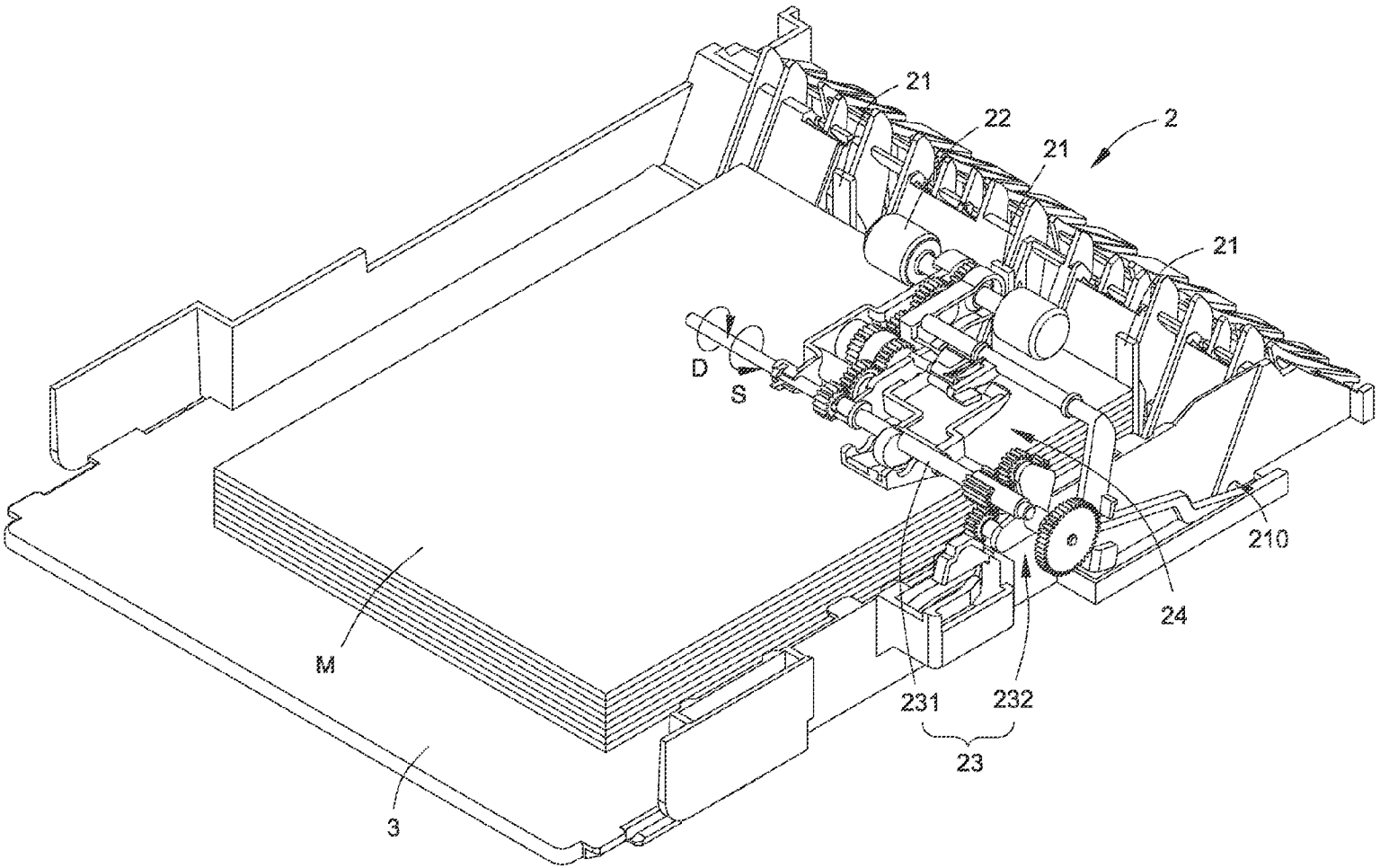
FIG. 2 is a schematic perspective view illustrating a sheet pick-up device of an automatic document feeder according to an embodiment of the present invention.

FIG. 2 is a schematic perspective view illustrating a sheet pick-up device of an automatic document feeder according to an embodiment of the present invention. As shown in FIG. 2, the sheet pick-up device 2 comprises a two-way clutch transmission mechanism 23, a sheet pick-up arm 22, plural stoppers 21 and a linking assembly 24. The two-way clutch transmission mechanism 23 comprises a power input shaft 231 and a clutch gear set 232. When the power input shaft 231 is driven by a motor (not shown), the power input shaft 231 is rotated in either a clockwise direction D or an anti-clockwise direction S, and thus the paper sheet M supported on the sheet input tray 3 may be smoothly fed into the sheet-feeding channel by the sheet pick-up device 2. Moreover, as shown in FIG. 2, the sheet pick-up device 2 further comprises a stopper linking rod 210, which is perpendicular to the stoppers 21.

Figure 3:
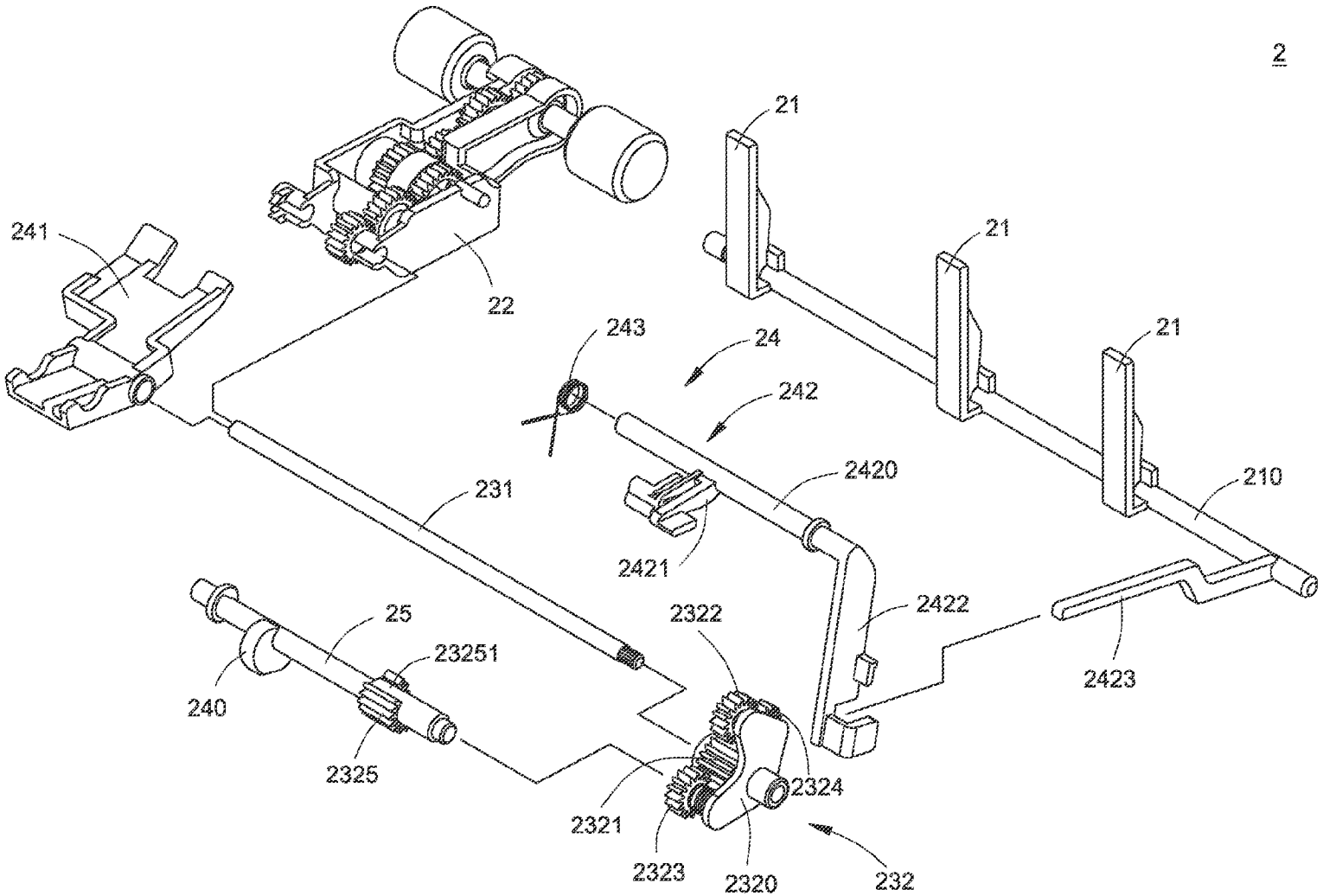
FIG. 3 is a schematic exploded view illustrating the sheet pick-up device as shown in FIG. 2.

FIG. 3 is a schematic exploded view illustrating the sheet pick-up device as shown in FIG. 2. The clutch gear set 232 comprises a position-changing plate 2320, a driving gear 2321, a first switching gear 2322, a second switching gear 2323, a transmission gear 2324 and a notched gear 2325. The notched gear 2325 has a notch 23251 in a periphery thereof. The notched gear 2325 is disposed on a rotary shaft 25. The driving gear 2321, the first switching gear 2322, the second switching gear 2323 and the transmission gear 2324 are disposed on the position-changing plate 2320. The transmission gear 2324 is engaged with the driving gear 2321 and the first switching gear 2322. The linking assembly 24 comprises a cam 240, a swinging arm 241 and a repositioning structure 242. Both of the cam 240 and the notched gear 2325 are disposed on the same rotary shaft 25. The swinging arm 241 is disposed on the power input shaft 231, and swung in response to a rotary motion of the cam 240. The repositioning structure 242 comprises a rotating rod 2420, a poking part 2421, a torsion spring 243, a first linking element 2422 and a second linking element 2423. The poking part 2421 is perpendicular to the rotating rod 2420, and contacted with the swinging arm 241. The torsion spring 243 is sheathed around the rotating rod 2420 and contacted with the poking part 2421 for exerting a torsion force on the poking part 2421. The first linking element 2422 is connected to an end of the rotating rod 2420. The second linking element 2423 is perpendicular to the stopper linking rod 210.

Figure 4:
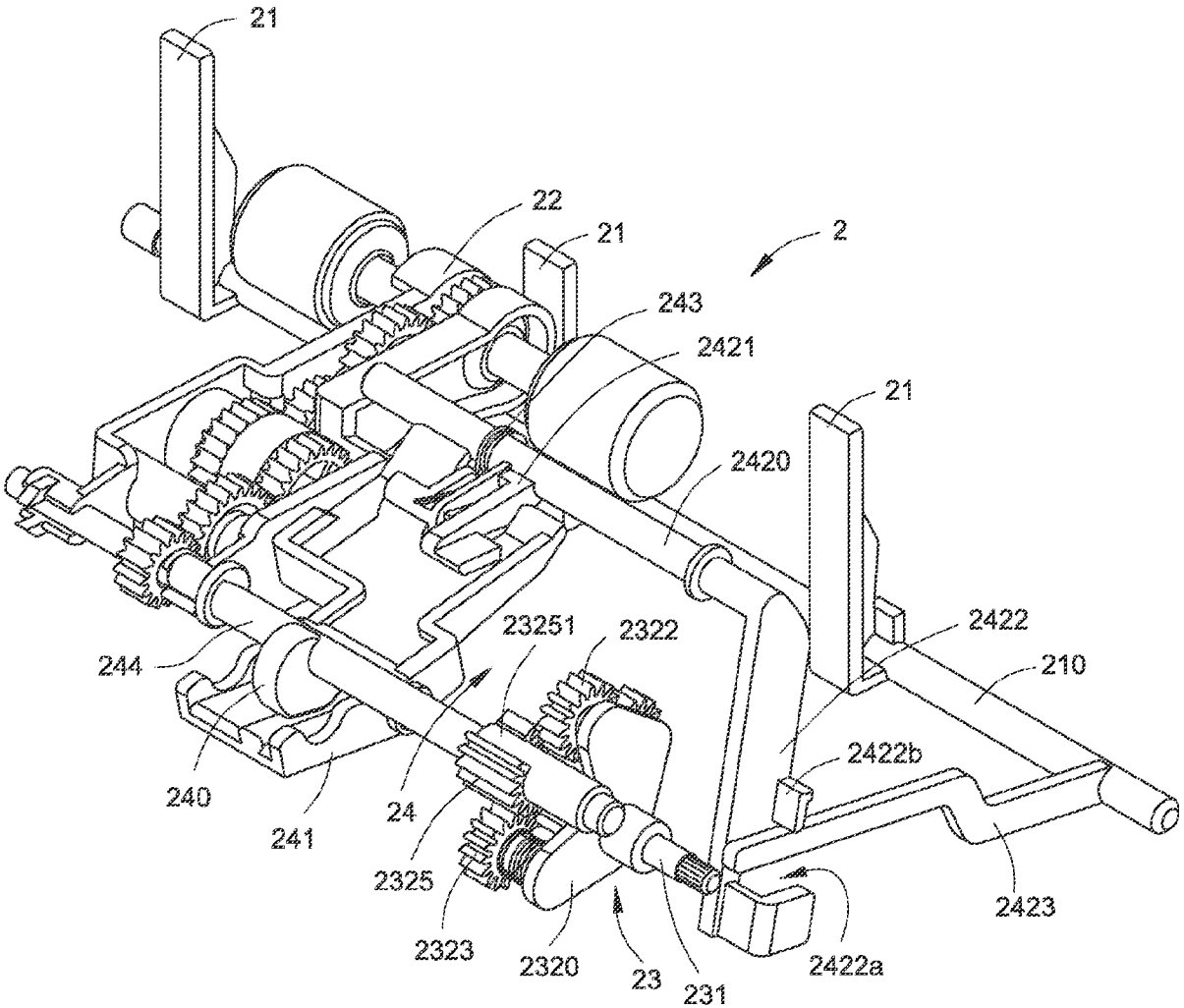
FIG. 4 is a schematic assembled view illustrating the sheet pick-up device as shown in FIG. 3, in which the sheet pick-up device is in a standby status.

FIG. 4 is a schematic assembled view illustrating the sheet pick-up device as shown in FIG. 3, in which the sheet pick-up device is in a standby status. The first linking element 2422 comprises a hollow part 2422*a* and a position-limiting structure 2422*b*. The second linking element 2423 is penetrated through the hollow part 2422*a*, and contacted with the position-limiting structure 2422*b* of the first linking element 2422.

Figure 5A:
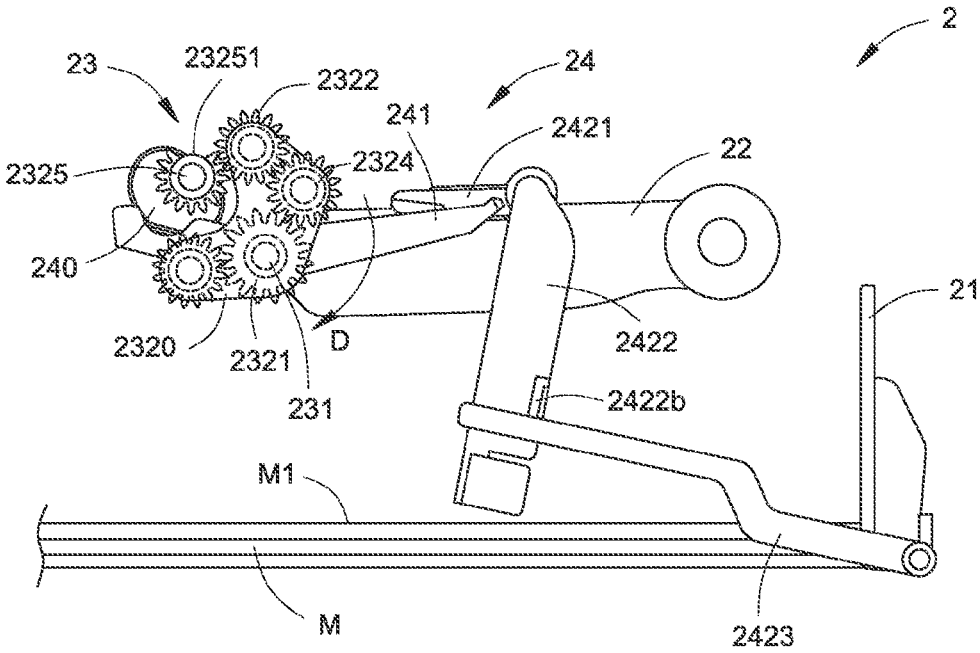
FIG. 5A is a schematic side view illustrating the sheet pick-up device of the present invention, in which the sheet pick-up device is in a standby status.

FIG. 5A is a schematic side view illustrating the sheet pick-up device of the present invention, in which the sheet pick-up device is in a standby status. Please refer to FIGS. 4 and 5A. When the power input shaft 231 is driven by the motor to rotate in the clockwise direction D, the sheet pick-up arm 22 is moved with the power input shaft 231 to be in a standby position. As the power input shaft 231 is rotated, the position-changing plate 2320 is rotated, so that the first switching gear 2322 is engaged with the notched gear 2325 and the notched gear 2325 is rotated with the position-changing plate 2320. Since the notched gear 2325 is rotated with the cam 240, the swinging arm 241 is swung to push the poking part 2421 upwardly. In such manner, the first linking element 2422 is nearly upright. As the second linking element 2423 is moved with the first linking element 2422, the second linking element 2423 is contacted with the position-limiting structure 2422*b*, and the stopper 21 is moved to a stopping position. When the stopper 21 is in the stopping position, the first paper sheet M1 of the paper sheets M is stopped from entering the sheet-feeding channel. Until the notch 23251 of the notched gear 2325 is rotated to be aligned with the first switching gear 2322, the first switching gear 2322 runs idle.

Figure 5B:
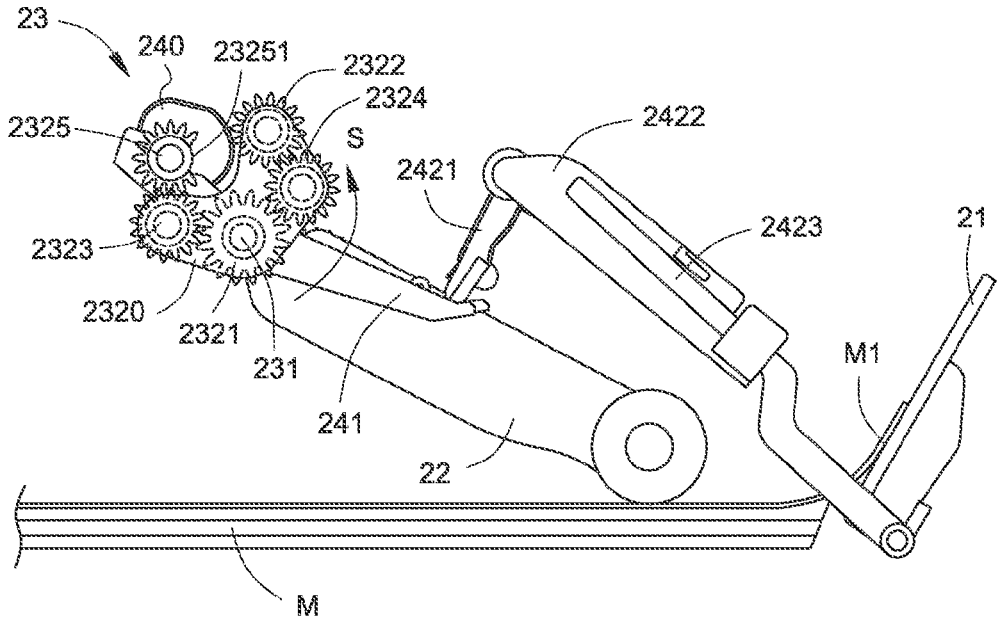
FIG. 5B is a schematic side view illustrating the sheet pick-up device of the present invention, in which the sheet pick-up device is in a sheet pick-up status.
Figure 6:
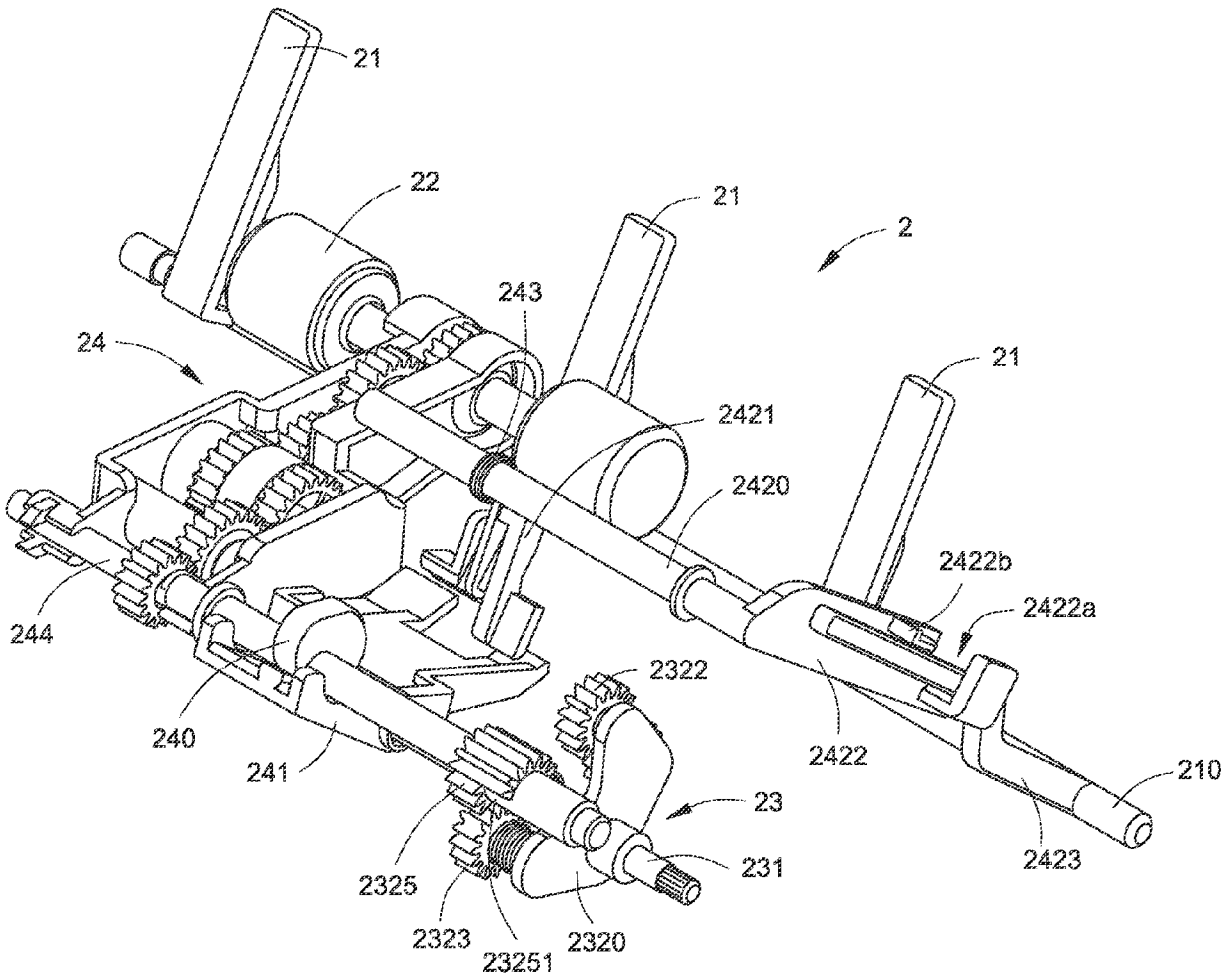
FIG. 6 is a schematic assembled view illustrating the sheet pick-up device of the present invention, in which the sheet pick-up device is in a sheet pick-up status.

FIG. 5B is a schematic side view illustrating the sheet pick-up device of the present invention, in which the sheet pick-up device is in a sheet pick-up status. FIG. 6 is a schematic assembled view illustrating the sheet pick-up device of the present invention, in which the sheet pick-up device is in a sheet pick-up status. Please refer to FIGS. 5B and 6. When the power input shaft 231 is driven by the motor to rotate in the anti-clockwise direction S, the sheet pick-up arm 22 is moved with the power input shaft 231 to be in a sheet pick-up position. As the power input shaft 231 is rotated, the position-changing plate 2320 is rotated, so that the second switching gear 2323 is engaged with the notched gear 2325 and the notched gear 2325 is rotated with the position-changing plate 2320. Since the notched gear 2325 is rotated with the cam 240, the poking part 2421 is no longer pushed upwardly by the swinging arm 241. In such manner, the first linking element 2422 and the second linking element 2423 are tilted. As such, the stopper 21 is moved to a non-stopping position. When the stopper 21 is in the non-stopping position, the first paper sheet M1 of the paper sheets M is allowed to be fed into the sheet-feeding channel. Until the notch 23251 of the notched gear 2325 is rotated to be aligned with the second switching gear 2323, the second switching gear 2323 runs idle.

From the above description, the sheet pick-up device of the present invention uses the two-way clutch transmission mechanism 23 to change the action of the linking assembly 24. Since the action of the linking assembly 24 is changed, the sheet pick-up arm 22 and the stopper 21 are moved in opposite directions to achieve the purpose of either stopping a paper sheet from entering a sheet-feeding channel of the automatic document feeder or feeding the paper sheet into the sheet-feeding channel.

As previously described in the prior art, by rubbing the elastic element 111*a* and a corresponding coupling element 112 against each other to generate a friction force, the swinging arm 110 is swung, and thus the function of either stopping the paper sheet or allowing the paper sheet to be fed into the sheet-feeding channel is implemented. According to the prior art technology, the elastic element 111*a* and the coupling element 112 may be suffered from thermal deformation. The rubbing problem may eventually abrade the elastic element 111*a*, and deteriorate the long-term operating stability. Whereas, according to the present invention, the sheet pick-up arm 22, the swinging arm 241 and the driving gear 2321 are disposed on the same power input shaft 231. As a consequence, when the power input shaft 231 is rotated, the sheet pick-up arm 22, the swinging arm 241 and the driving gear 2321 are synchronously operated. In this situation, the operation time between components is reduced, and the operating stability of the sheet pick-up device of the present invention will be enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet pick-up device of an automatic document feeder, said sheet pick-up device having functions of stopping a paper sheet from entering a sheet-feeding channel and feeding said paper sheet into said sheet-feeding channel, said sheet pick-up device comprising:

a two-way clutch transmission mechanism comprising a power input shaft and a clutch gear set coaxial with said power input shaft, wherein said power input shaft is driven to rotate in either a clockwise direction or an anti-clockwise direction by a motor;

a sheet pick-up arm fixedly connected to said power input shaft for transporting said paper sheet into said sheet-feeding channel;

a stopper for stopping said paper sheet from entering said sheet-feeding channel; and a linking assembly connected to said power input shaft and said stopper, wherein when said power input shaft is rotated in said clockwise direction, said sheet pick-up arm is in a standby position, and said stopper is moved with said linking assembly to be in a stopping position, so that said paper sheet is stopped from entering said sheet-feeding channel, wherein when said power input shaft is rotated in said anti-clockwise direction, said sheet pick-up arm is in a sheet pick-up position, and said stopper is moved with said linking assembly to be in a non-stopping position, so that said paper sheet is allowed to be fed into said sheet-feeding channel, wherein said clutch gear set comprises:

a position-changing plate sheathed around said power input shaft, and fixed on said power input shaft;

a driving gear disposed on said position-changing plate, and sheathed around said power input shaft;

a first switching gear disposed on said position-changing plate;

a second switching gear disposed on said position-changing plate, and engaged with said driving gear; and a notched gear disposed on a rotary shaft, and having a notch in a periphery thereof, wherein when said power input shaft is rotated in said clockwise direction, said position-changing plate is rotated, so that said first switching gear is engaged with notched gear, said notched gear is rotated with said first switching gear, and said stopper is moved with said linking assembly to be in said stopping position, wherein until said notch of said notched gear is rotated to be aligned with said first switching gear, said first switching gear runs idle, wherein when said power input shaft is rotated in said anti-clockwise direction, said position-changing plate is rotated, so that said second switching gear is engaged with notched gear, said notched gear is rotated with said second switching gear, and said stopper is moved with said linking assembly to be in said non-stopping position, wherein until said notch of said notched gear is rotated to be aligned with said second switching gear, said second switching gear runs idle.

2. The sheet pick-up device of an automatic document feeder according to claim 1 wherein said clutch gear set further comprises a transmission gear, which is disposed on said position-changing plate, and engaged with said driving gear and said first switching gear.

3. The sheet pick-up device of an automatic document feeder according to claim 1 wherein said stopper is perpendicularly disposed on a stopper linking rod, and said linking assembly comprises:

a cam disposed on said rotary shaft;

a swinging arm disposed on said power input shaft, and swung in response to a rotary motion of said cam; and a repositioning structure comprising:

a rotating rod;

a poking part perpendicular to said rotating rod, and contacted with said swinging arm;

a torsion spring sheathed around said rotating rod, and contacted with said poking part for exerting a torsion force on said poking part;

a first linking element connected to an end of said rotating rod; and a second linking element perpendicular to said stopper linking rod and contacted with said first linking element.

4. The sheet pick-up device of an automatic document feeder according to claim 3 wherein said rotary shaft is parallel with said power input shaft.

5. The sheet pick-up device of an automatic document feeder according to claim 3 wherein said notched gear, said rotary shaft and said cam are integrally formed.

6. The sheet pick-up device of an automatic document feeder according to claim 3 wherein said first linking element comprises a hollow part and a position-limiting structure, and said second linking element is penetrated through said hollow part, and contacted with said position-limiting structure of said first linking element.

* * * * *